US010883505B2

(12) United States Patent
Lee

(10) Patent No.: US 10,883,505 B2
(45) Date of Patent: Jan. 5, 2021

(54) LIQUID-RING COMPRESSOR INCLUDING BYPASS PIPE

(71) Applicant: Vaccomp Co., Ltd., Incheon (KR)

(72) Inventor: Seok Won Lee, Incheon (KR)

(73) Assignee: VACCOMP CO., LTD., Incheon (KR)

( * ) Notice: Subject to any disclaimer, the term of this patent is extended or adjusted under 35 U.S.C. 154(b) by 121 days.

(21) Appl. No.: 16/291,179

(22) Filed: Mar. 4, 2019

(65) Prior Publication Data

US 2020/0217318 A1 Jul. 9, 2020

(30) Foreign Application Priority Data

Jan. 9, 2019 (KR) ..... 10-2019-0002573

(51) Int. Cl.
*F04C 28/26* (2006.01)
*F04C 19/00* (2006.01)

(52) U.S. Cl.
CPC ..... *F04C 28/265* (2013.01); *F04C 19/001* (2013.01); *F04C 19/005* (2013.01); *F04C 2240/30* (2013.01); *F04C 2240/806* (2013.01)

(58) Field of Classification Search
CPC .... F04C 19/001; F04C 19/005; F04C 28/265; F04C 2240/30; F04C 2240/806; F04D 27/02; F04D 27/0207; F04D 27/0215
USPC ..... 417/68
See application file for complete search history.

(56) References Cited

U.S. PATENT DOCUMENTS 3,741,676 A * 6/1973 Silvern ..... F04D 27/0215 415/58.1
4,422,832 A * 12/1983 Haavik ..... F04C 19/00 417/68
8,881,759 B1 * 11/2014 Shtekelmacher ..... F16K 31/128 137/489
2013/0341822 A1 * 12/2013 Ellgass ..... B22C 9/103 264/219

FOREIGN PATENT DOCUMENTS

KR 10-2015-0020025 2/2015

* cited by examiner

*Primary Examiner* — Connor J Tremarche
(74) *Attorney, Agent, or Firm* — Lex IP Meister. PLLC

(57) ABSTRACT

Disclosed is a liquid-ring compressor including a bypass pipe, in which the bypass pipe is directly mounted to a main body of the liquid-ring compressor, thereby greatly reducing costs incurred in the installation of a facility or a system including the liquid-ring compressor, and also economically reducing maintenance costs. The liquid-ring compressor includes a main body accommodating a shaft centrally mounted therein to receive rotational force from a driving motor, a rotor configured to rotate together with the shaft inside the main body, a suction port formed at a portion of the main body, a discharge port formed at another portion of the main body, a bypass pipe mounted between a position adjacent to the suction port in the main body and a position adjacent to the discharge port in the main body, and an opening/closing valve mounted in the middle of the bypass pipe.

4 Claims, 6 Drawing Sheets

[FIG. 1]
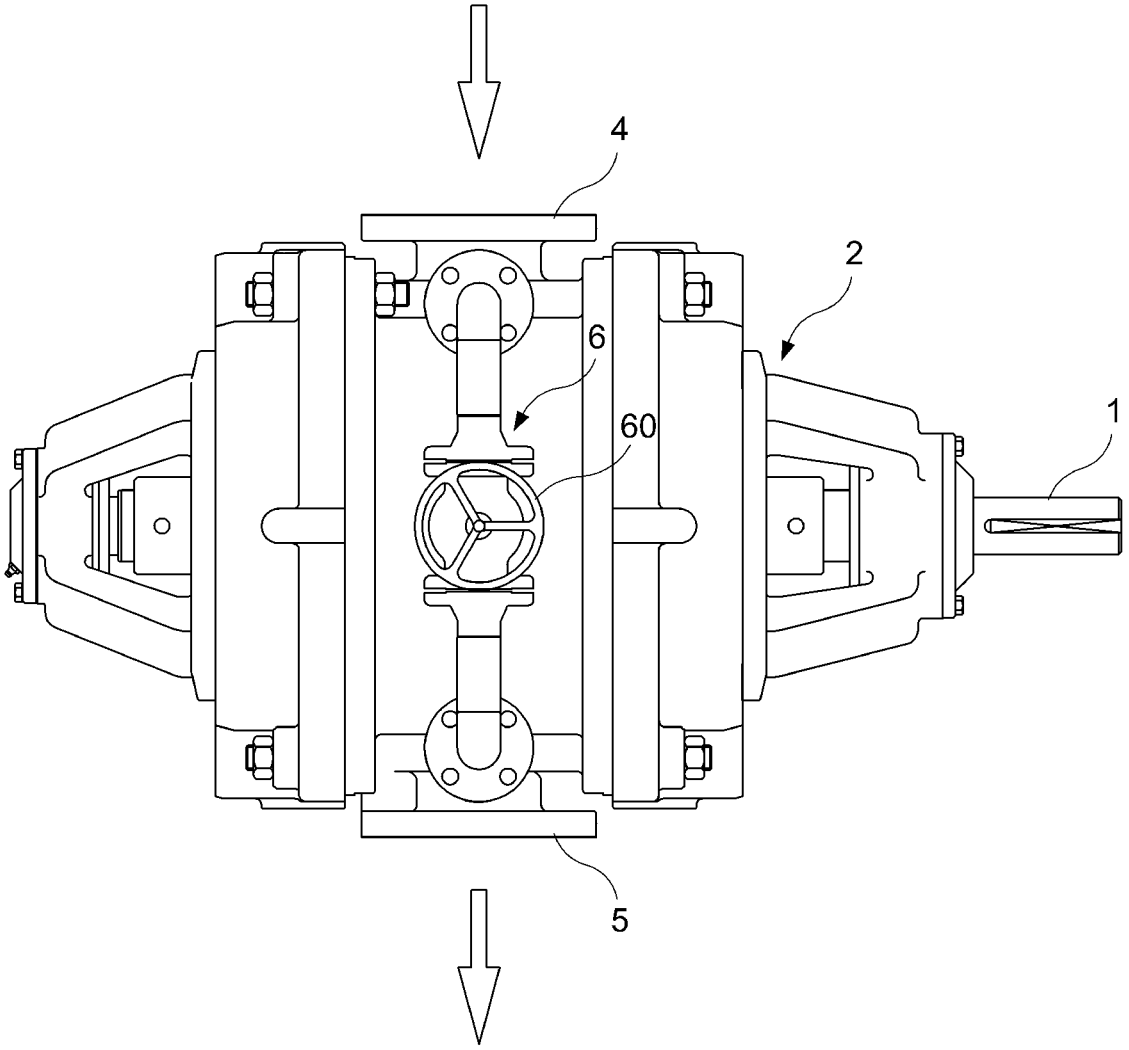

[FIG. 2]
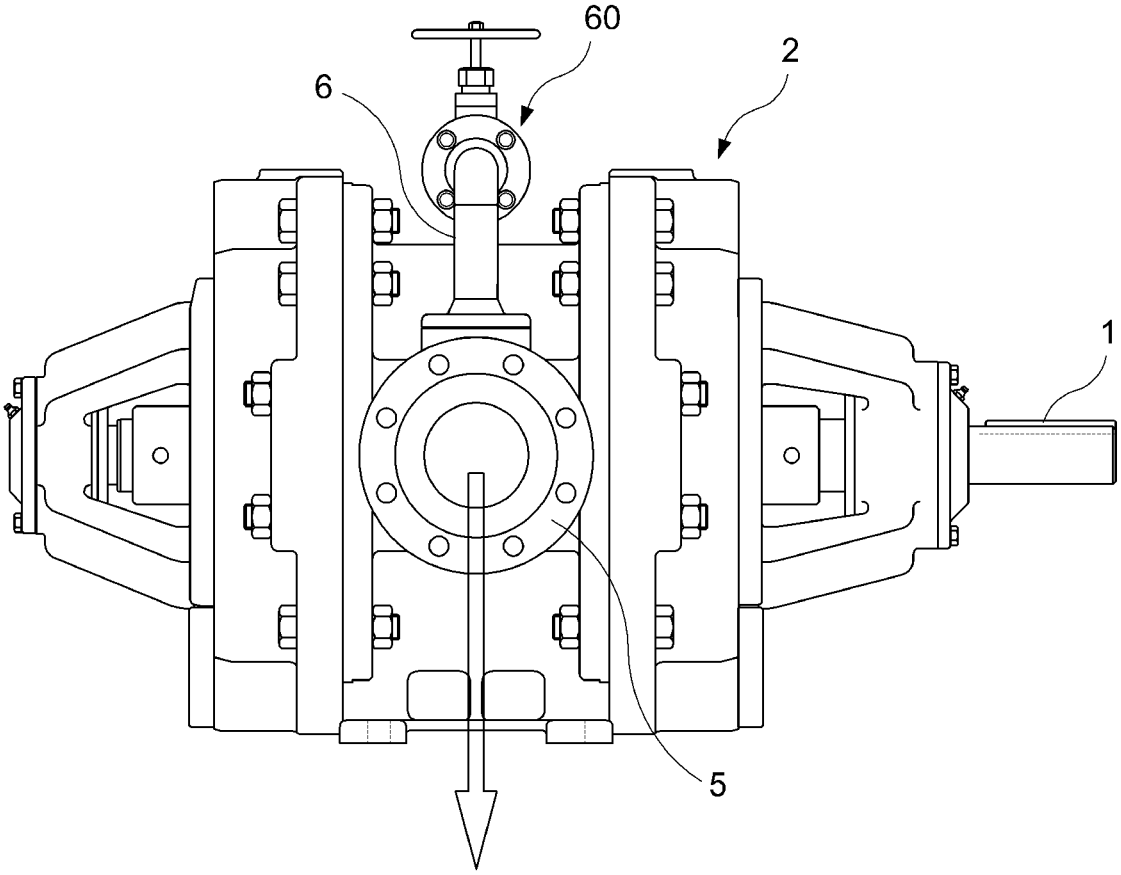

[FIG. 3]
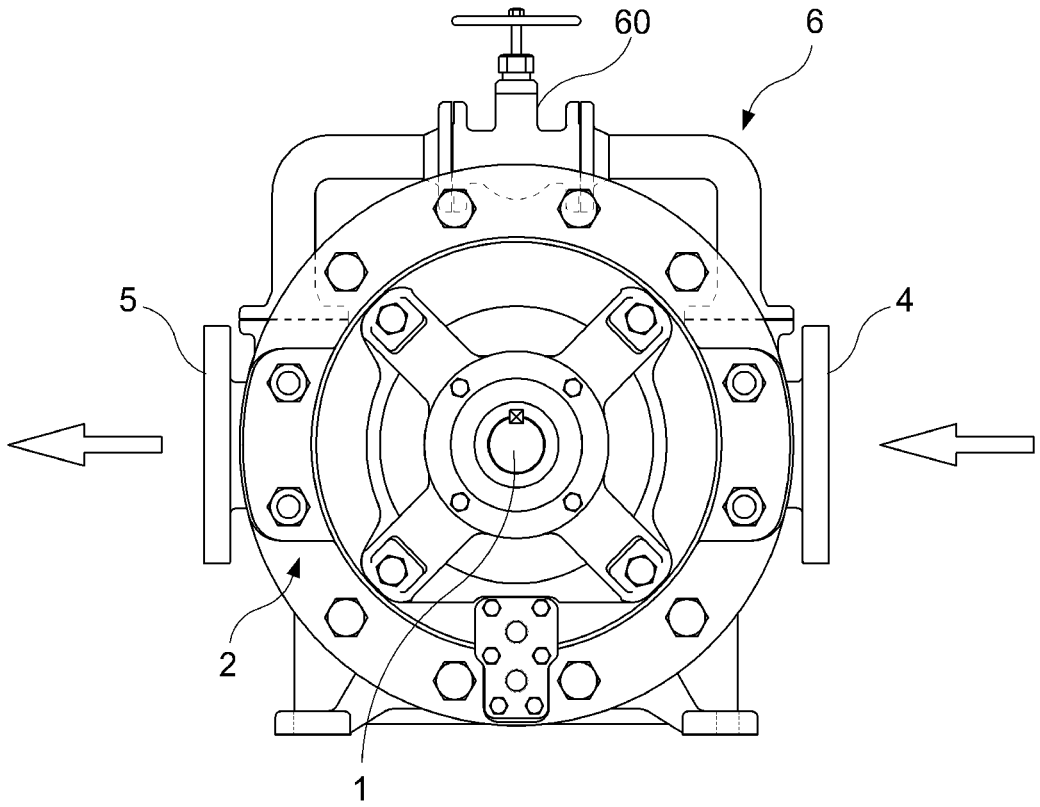

[FIG. 4]
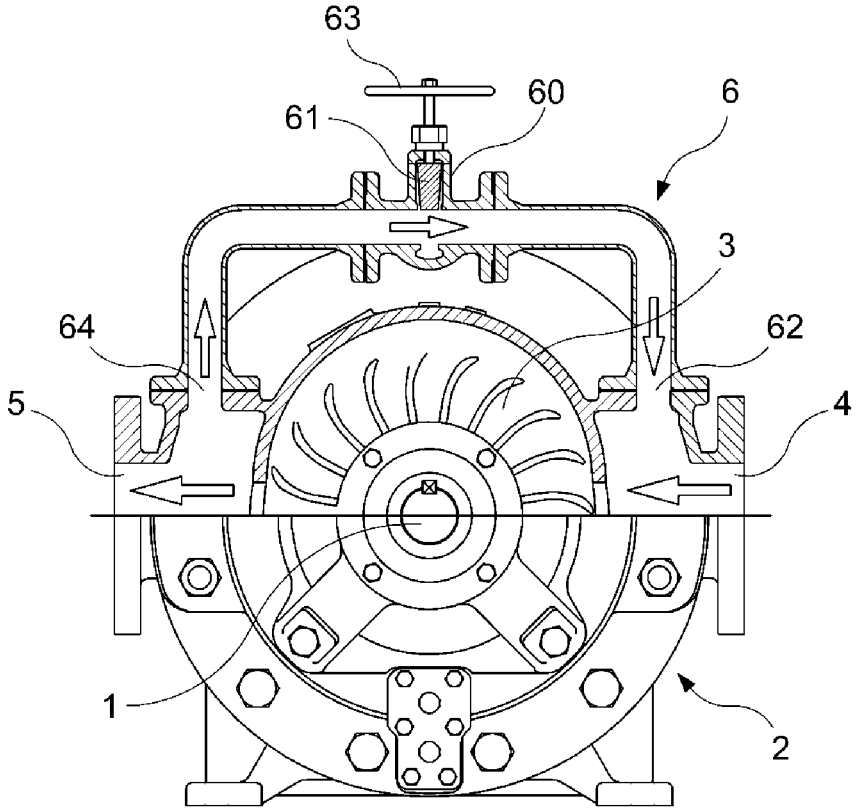

[FIG. 5]
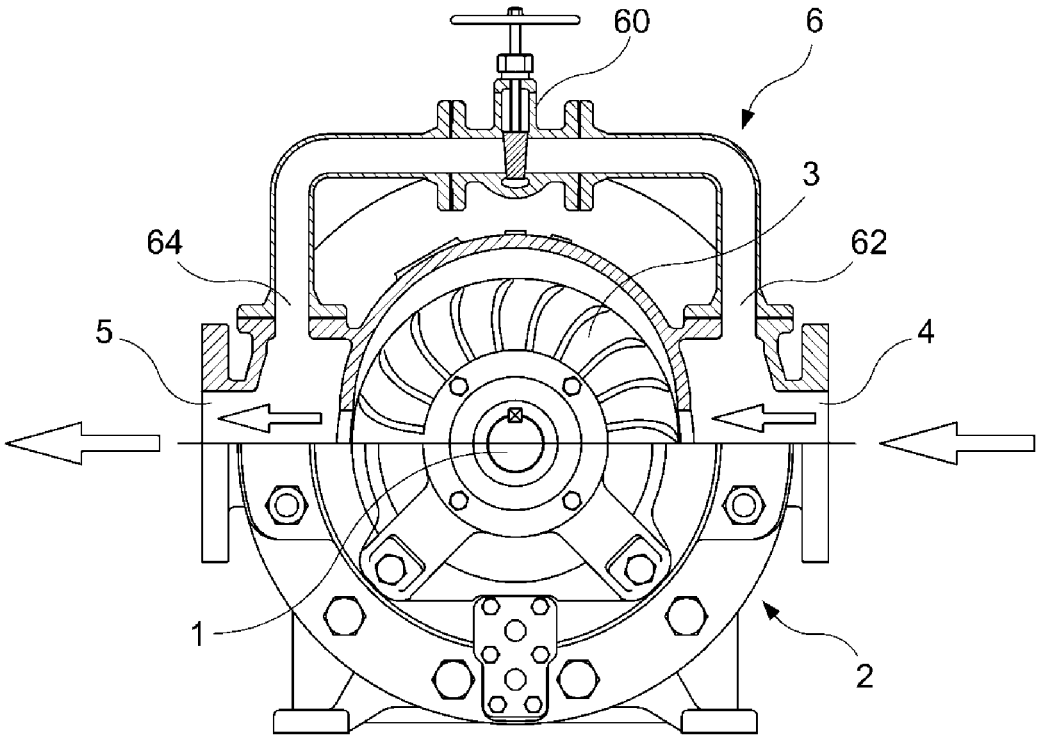

[FIG. 6]
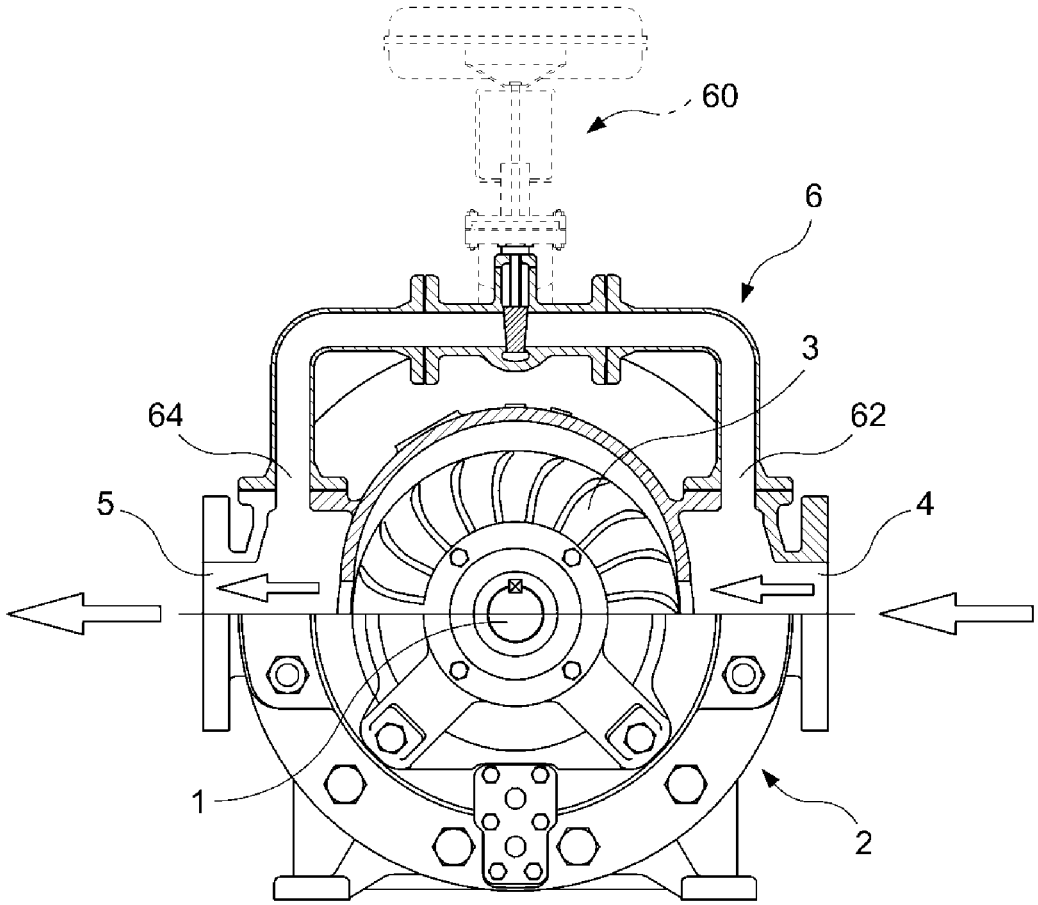
[FIG. 7]
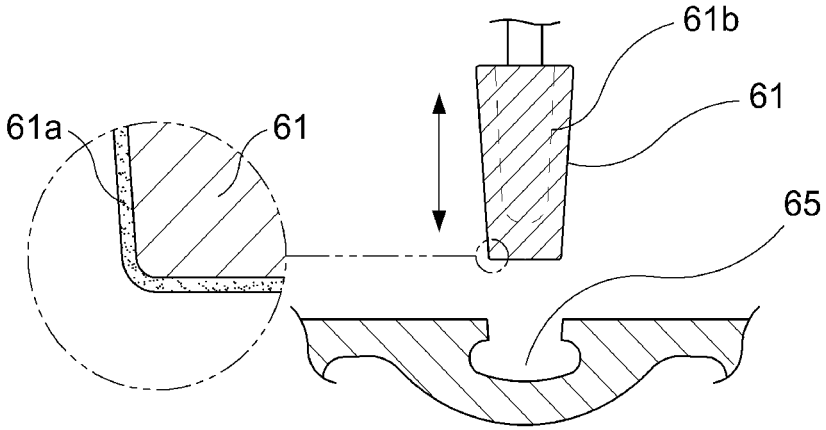

LIQUID-RING COMPRESSOR INCLUDING BYPASS PIPE

BACKGROUND OF THE INVENTION

Field of the Invention

The present invention relates to a liquid-ring compressor, and more particularly to a liquid-ring compressor including a bypass pipe, in which the bypass pipe is directly mounted to a main body of the liquid-ring compressor, thereby greatly reducing costs incurred in the installation of a facility or a system including the liquid-ring compressor, and also economically reducing maintenance costs.

Description of the Related Art

In general, a liquid-ring compressor is commercially used as a device in which the rotary motion of an impeller mounted therein generates centrifugal force to cause a medium introduced thereinto to rotate, thereby compressing and discharging the medium.

A conventional exemplary liquid-ring compressor is disclosed in Korean Patent Laid-open Publication No. 10-2015-0020025.

In the conventional technology disclosed in the above related art document, a bypass pipe is mounted in a system equipped with a compressor, separately from the main body of the compressor, during the process of laying pipes in the system.

The reason for mounting a separate bypass pipe is to ensure the stable operation of the liquid-ring compressor. Described in detail, in the initial operation of the liquid-ring compressor, the bypass pipe is opened in order to prevent an excessive increase in the initial pressure. Subsequently, when the working pressure of the discharge side of the compressor is normalized and is maintained at a constant level, the bypass pipe is closed, whereby the compressor maintains a normal operation state.

However, if a bypass pipe is mounted as a part of an entire system, separately from a compressor, the system occupies a relatively large space, which incurs an increase in installation costs. Further, during maintenance, the entire system needs to be stopped, which is inefficient and uneconomical.

RELATED ART DOCUMENT

Patent Document (Patent Document 1) Korean Patent Laid-open Publication No. 10-2015-0020025 (published on Feb. 25, 2015)

SUMMARY OF THE INVENTION

Therefore, the present invention has been made in view of the above problems, and it is an object of the present invention to provide a liquid-ring compressor including a bypass pipe, in which the bypass pipe is directly mounted to a main body of the liquid-ring compressor, thereby greatly reducing the costs incurred in the installation of a facility or a system including the liquid-ring compressor, and also economically reducing maintenance costs.

In accordance with the present invention, the above and other objects can be accomplished by the provision of a liquid-ring compressor including a main body accommodating a shaft centrally mounted therein to receive rotational force from a driving motor, a rotor configured to rotate together with the shaft inside the main body, a suction port formed at a portion of the main body, a discharge port formed at another portion of the main body, a bypass pipe mounted between a position adjacent to the suction port in the main body and a position adjacent to the discharge port in the main body, and an opening/closing valve mounted in the middle of the bypass pipe.

The bypass pipe may include an inlet port and an outlet port, and may be mounted such that the outlet port is located at a position adjacent to the suction port in the main body and the inlet port is located at a position adjacent to the discharge port in the main body.

The opening/closing valve mounted in the middle of the bypass pipe may be a manual valve.

The opening/closing valve mounted in the middle of the bypass pipe may be an automatic valve.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a plan view illustrating an exemplary embodiment to which the function of the present invention is applied;

FIG. 2 is a front view of the embodiment shown in FIG. 1;

FIG. 3 is a partially omitted side view of the embodiment shown in FIG. 1;

FIG. 4 is a partially cut-away side view of the embodiment shown in FIG. 3, which illustrates the open state of an opening/closing valve;

FIG. 5 is a partially cut-away side view of the embodiment shown in FIG. 3, which illustrates the closed state of the opening/closing valve;

FIG. 6 is a partially cut-away side view illustrating another exemplary embodiment to which the function of the present invention is applied; and FIG. 7 is a partial cross-sectional view illustrating the configuration of a liquid-ring compressor according to another embodiment of the present invention.

DETAILED DESCRIPTION OF THE INVENTION

Hereinafter, exemplary embodiments of the present invention will be described in detail with reference to the accompanying drawings.

First, as one embodiment of the present invention, the configuration of a liquid-ring compressor will be described with reference to FIGS. 1 to 5.

In this embodiment, the liquid-ring compressor includes a main body 2, in which a shaft 1 configured to receive rotational force from a driving motor is centrally mounted, a rotor 3, which is configured to rotate together with the shaft 1 inside the main body 2, a suction port 4, which is formed at a portion of the main body 2, and a discharge port 5, which is formed at another portion of the main body 2. The liquid-ring compressor further includes a bypass pipe 6, which is mounted between a position adjacent to the suction port 4 in the main body 2 and a position adjacent to the discharge port 5 in the main body 2, and an opening/closing valve 60, which is mounted in the middle of the bypass pipe 6 and includes a valve body 61 and an opening/closing handle 63.

The bypass pipe 6 includes an inlet port 64 and an outlet port 62, and is mounted such that the outlet port 62 is located at a position adjacent to the suction port 4 in the main body 2 and the inlet port 64 is located at a position adjacent to the discharge port 5 in the main body 2.

In the embodiment illustrated in FIGS. 1 to 5, the opening/closing valve 60, which is mounted in the middle of the bypass pipe 6, may be a manual valve.

Alternatively, unlike the previously described embodiment, as illustrated in FIG. 6, the opening/closing valve 60, which is mounted in the middle of the bypass pipe 6, may be an automatic valve.

Hereinafter, the operational effects of the liquid-ring compressor according to the present invention, configured as described above, will be described.

The bypass pipe 6 according to the present invention is mounted between a position adjacent to the suction port 4, which is formed at a portion of the main body 2, and a position adjacent to the discharge port 5, which is formed at another portion of the main body 2, and the opening/closing valve 60 is mounted in the middle of the bypass pipe 6.

Here, the bypass pipe 6 is mounted such that the outlet port 62 thereof is located at a position adjacent to the suction port 4 in the main body 2 and the inlet port 64 thereof is located at a position adjacent to the discharge port 5 in the main body 2.

Of course, the opening/closing valve 60 may be configured as any one of a manual valve and an automatic valve.

When the compressor does not operate, i.e. is in a non-operating state, the opening/closing valve 60, which is located in the middle of the bypass pipe 6, is maintained in a closed state. When the compressor needs to be operated, the opening/closing valve 60 is first opened. In the state in which the opening/closing valve 60 is opened, when the compressor begins to operate, the shaft 2 and the rotor 3 rotate, and thus the initial internal pressure in the compressor may excessively increase. At this time, the medium in the compressor temporarily moves along the inlet port 64 of the bypass pipe 6, the opening/closing valve 60, and the outlet port 62 of the bypass pipe 6, and returns to the main body 2 due to the internal pressure, thereby preventing an increase in the internal pressure. Subsequently, when the working pressure of the discharge port 5 of the compressor is normalized and is maintained at a stable level, the opening/closing valve 60 mounted in the bypass pipe 6 is changed from an open state to a closed state to block the flow of the medium along the bypass pipe 6, whereby the compressor maintains a normal operation state.

Therefore, according to the present invention, since the bypass pipe 6 is directly mounted to the main body 2 of the compressor, costs incurred in the installation of a facility or a system including the compressor are greatly reduced, and maintenance tasks are easily and effectively performed merely by demounting only the compressor from the facility or the system, which also economically reduces maintenance costs.

FIG. 7 is a partial cross-sectional view illustrating the configuration of a liquid-ring compressor according to another embodiment of the present invention. The opening/closing valve 60 includes a reinforcing coating layer 61*a* coated on the surface of the valve body 61, which is configured to open or close the flow passage in the bypass pipe 6, and a leaf spring 61*b*, which has a "U" shape in order to increase the elastic pressing force thereof and is mounted inside the valve body 61.

Preferably, the reinforcing coating layer 61*a* has a composition including 30 to 50% by weight of urethane powder, 10 to 30% by weight of paraffin wax, 10 to 30% by weight of fine oyster shell powder, 10 to 30% by weight of urea resin, and 1 to 10% by weight of thermoplastic elastomer.

The reinforcing coating layer 61*a* and the leaf spring 61*b*, configured as described above, serve to further improve the durability and the gas-tightness of the valve body 61.

Since the surface strength of the valve body 61 is reinforced by the reinforcing coating layer 61*a*, it is possible to prevent deformation or damage to the valve body attributable to frequent contact and friction with a valve-seating recess 65 in the opening/closing operation. Further, since the leaf spring 61*b* increases the force that elastically supports the valve body 61, the contact force with the valve-seating recess 65 is increased, and the gas-tightness of the valve body 61 is therefore maximized.

In particular, the paraffin wax, which is a hydrocarbon mixture contained in the reinforcing coating layer 61*a*, causes the coating layer to maintain a constant thickness, the fine oyster shell powder enhances the durability of the coating layer, the urea resin increases the binding force of the fine oyster shell powder, and the thermoplastic elastomer stabilizes the adhesion of the coating layer to the valve body 61 and reinforces the elasticity of the coating layer together with the urethane powder.

As is apparent from the above description, according to the present invention, since the bypass pipe is directly mounted to the main body of the compressor, costs incurred in the installation of a facility or a system including the compressor are greatly reduced, and maintenance tasks are easily and effectively performed merely by demounting only the compressor from the facility or the system, which also economically reduces maintenance costs.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A liquid-ring compressor comprising:

a main body accommodating a shaft centrally mounted therein to receive a rotational force from a driving motor;

a rotor configured to rotate together with the shaft inside the main body;

a suction port formed at a portion of the main body;

a discharge port formed at another portion of the main body;

a bypass pipe mounted between a position adjacent to the suction port in the main body and a position adjacent to the discharge port in the main body; and an opening/closing valve mounted in a middle of the bypass pipe, wherein the opening/closing valve comprises:

a valve body configured to open or close a flow passage in the bypass pipe;

a reinforcing coating layer coated on a surface of the valve body, the reinforcing coating layer having a composition comprising urethane powder, paraffin wax, fine oyster shell powder, urea resin, and thermoplastic elastomer; and a leaf spring mounted inside the valve body, the leaf spring having a "U" shape to increase an elastic pressing force thereof.

2. The liquid-ring compressor according to claim 1, wherein the bypass pipe comprises an inlet port and an outlet port, and wherein the bypass pipe is mounted such that the outlet port is located at a position adjacent to the suction port in the main body and the inlet port is located at a position adjacent to the discharge port in the main body.

3. The liquid-ring compressor according to claim 1, wherein the opening/closing valve mounted in the middle of the bypass pipe is a manual valve.

4. The liquid-ring compressor according to claim 1, wherein the opening/closing valve mounted in the middle of the bypass pipe is an automatic valve.

* * * * *